US005887948A

United States Patent [19]

Hannes

[11] Patent Number: 5,887,948

[45] Date of Patent: Mar. 30, 1999

[54] BODY SUPPORT RATCHETING MECHANISM

[75] Inventor: Joseph Hannes, Franklin, Wis.

[73] Assignee: The Brewer Company, Menomonee Falls, Wis.

[21] Appl. No.: 802,708

[22] Filed: Feb. 19, 1997

[51] Int. Cl.[6] ..... A47C 7/54

[52] U.S. Cl. ..... 297/411.35; 297/411.31; 297/344.22; 248/118; 248/289.11

[58] Field of Search ..... 297/411.35, 411.31, 297/344.21, 344.22; 248/118, 118.5, 289.11, 292.12

[56] References Cited

U.S. PATENT DOCUMENTS

| | | | |
|---|---|---|---|
| 3,338,626 | 8/1967 | Hamilton | 297/411.31 |
| 4,429,918 | 2/1984 | Alsup, Jr. et al. | 297/411.35 |
| 4,438,975 | 3/1984 | Williams | 297/411.35 |
| 4,452,487 | 6/1984 | Plowman | 297/411.35 |
| 5,490,716 | 2/1996 | Naughton | 297/411.35 |

*Primary Examiner*—Milton Nelson, Jr.
*Assistant Examiner*—Anthony D. Barfield
*Attorney, Agent, or Firm*—Ryan Kromholz & Manion, S.C.

[57] ABSTRACT

A body support ratcheting mechanism for a medical or dental chair or stool. The body support ratcheting mechanism includes a shaft that is attached to the chair or stool. A body support member is attached to the top or upper surface of the mechanism. Within the mechanism a ratchet, mounted to the shaft, and a pawl, mounted within the mechanism housing, allow the body support member to be pivoted toward the abdomen of the chair occupant to a comfortable position. When the occupant leans against the body support ratcheting mechanism, the body support is held in position by the interlocking contact of the pawl and a ratchet gear tooth. For ease of egress from and ingress to the chair, the occupant can depress a spring biased release arm that allows for the body support member to be swung away from the chair.

11 Claims, 4 Drawing Sheets

BODY SUPPORT RATCHETING MECHANISM

BACKGROUND OF THE INVENTION

The present invention relates specifically to the field of medical and dental assistant's chairs and stools and generally to chairs and stools having body support members. Most common chairs and stools have, at a minimum, a surface that is generally parallel to the ground upon which a person or occupant sits. This surface is sometimes referred to as the seat of the stool or chair. In addition there may be an additional structure often referred to as a backrest. The backrest is generally substantially perpendicular to the seat. The function of the backrest is to provide a surface for the occupant of the stool or chair to rest his or her back against. This surface also provides back support for the occupant.

Specialized seating, including chairs and stools, is often used in the medical and dental profession. Because it is often necessary for the medical personnel to perform one or more procedures on a patient, seating for medical persons must be specially designed taking into account such things as the comfort of the medical provider, the comfort of the patient, and the safety of both the provider and patient.

It is often necessary that the medical provider lean over or position oneself directly over the patient in order to perform a medical treatment. A chair or stool having a traditional backrest, as described above, would be of little benefit in this situation. Instead requiring a structure that provides support to the back of the medical provider, a device that provides support to the front or abdomen of the person is necessary. This is achieved with the use of a chair or stool having a body support member. The body support member usually replaces the traditional backrest.

A body support is an elongated padded member that may be curved along its longitudinal axis. It is typically supported at one end by an arm or bracket that extends from the underside of the chair or stool seat to the body support. The height and position of the body support should be adjustable so that optimum comfort is imparted upon the chair or stool occupant.

A chair or stool having a body support member is designed for an application where the occupant must lean forward a predetermined amount and still requires support so as to not fall out of the chair or stool. This may occur when a patient is situated in a dental chair and the medical personnel must lean over the patient to administer medical treatment in the patient's mouth. Alternatively, the patient may be located in a bed and the medical personnel again must lean over the patient to initiate and complete a medical procedure. As opposed to a back support, the body support contacts the chair or stool occupant at the abdomen and thus provides support while restraining the occupant from leaning too far forward. Besides aiding in the comfort of the medical personnel, a body support also provides a degree of safety by restraining the medical personnel and preventing a situation in which the care giver may lean too far forward, lose his or her balance and thus fall onto the patient. The restraint provided by the body support adds to the comfort of the patient as well by creating a visible barrier upon which the medical provider can rely for support and balance.

In prior art chair and stool designs incorporating body supports, it was difficult to easily adjust the position of the body support relative to the position of the chair or stool seat. Prior art chair and stools having body support members require the occupant to either permanently lock the body support into place or to operate cumbersome mechanisms in order to easily adjust the body support. In the first case, permanency of the relative position of the body support with respect to the seat makes ingress and egress of the chair or stool difficult. A person must maneuver or work around the obstacle of the permanently positioned body support in order to sit down on or stand up from the chair or stool. In the latter situation, if it is too difficult to adjust the body support, the person is likely to not use the support or to rely upon the support when it is not locked into position. Either case provides a safety hazard to the occupant and patient.

The present invention comprises a novel construction of a body support ratcheting mechanism. The invention is placed between the body support structure and the bracket that extends from the underside of the chair or stool. The mechanism allows the body support to easily pivot about its support bracket and relative to the seat.

My invention provides a body support mechanism that is easy to operate, positively locks the body support into a locked position, unlocks for easy ingress to and egress from the chair or stool, and allows for adjustment during use. These and other benefits of my invention will become evident in the descriptions that follow.

SUMMARY OF THE INVENTION

My invention can be described as a body support ratcheting mechanism for pivotally supporting a body support member about a stool, the body support ratcheting mechanism comprising: a ratchet housing having at least one wall arranged to define an open cavity; a top and a bottom bearing plate, said plates being disposed above and below said ratchet housing respectively; a shaft having a first end and a second end, said first end attached to said stool; a ratchet gear having a plurality of ratchet teeth, said ratchet gear being mounted on the second end of said shaft; a pawl having a pawl engagement member, a pivot point, and a release handle, said pawl being pivotally mounted between said top bearing plate and said bottom bearing plate and said pawl engagement member being engagable with at least one tooth of said ratchet gear teeth; and said body support member attached to said ratchet housing.

The ratchet housing includes an opening and said pawl release handle passes through said opening and further, the mechanism may include at least one bushing, said bushing being positioned between said shaft and one of said plates. The ratchet gear has at least a first and a second aperture formed therein and said shaft has at least a first and a second aperture formed therein; said respective first and second apertures being in alignment; a pin passing through said aligned first apertures; and a fastener passing through said second ratchet gear aperture and threadedly engaging with said shaft second aperture. A spring having a first end and a second end may be provided wherein said first spring end is biased against said ratchet body cavity and said second spring end is biased against said pawl.

In another embodiment my invention may be described as a body support ratcheting mechanism for supporting a body support member about a stool, said body support ratcheting mechanism comprising: a ratchet housing having an interior cavity; an upper bearing plate and a lower bearing plate, the upper bearing plate and the lower bearing plate each having at least one shaft bearing, the upper plate being positioned on an upper surface of said ratchet housing and the lower plate being positioned on a lower surface of said ratchet housing; a pawl, said pawl being pivotally mounted between said upper plate and said lower plate within the ratchet housing cavity; a shaft having an end, said shaft passing through said lower plate shaft bearing and having a ratchet gear attached to said end; said ratchet gear being located within said ratchet body and having a plurality of ratchet gear teeth, at least one gear tooth being engagable with said pawl; a shaft end cap being attached to said ratchet gear, said shaft end cap passing through said upper plate shaft bearing.

In yet another embodiment, my invention comprises a shaft, said shaft having a first end and a second end, said first shaft end being connected to said stool; a ratchet gear having a plurality of ratchet gear teeth, said ratchet gear being attached to said second end of said shaft; a shaft end cap having a diameter substantially equivalent to said shaft, said end cap being attached to said ratchet gear; a ratchet body having an interior cavity, said ratchet gear and said end cap being located within said interior cavity; a pawl having a pawl engagement member, said pawl being pivotally mounted within said ratchet body; said pawl engagement member biased by a spring into removable contact with at least one ratchet gear tooth; said ratchet body having at least one bearing for supporting said shaft within said body and a mounting surface; said body support member being attached to said mounting surface.

DETAILED DESCRIPTION

Although the disclosure hereof is detailed and exact to enable those skilled in the art to practice the invention, the physical embodiments herein disclosed merely exemplity the invention which may be embodied in other specific structure. While the preferred embodiment has been described, the details may be changed without departing from the invention, which is defined by the claims.

Figure 1:
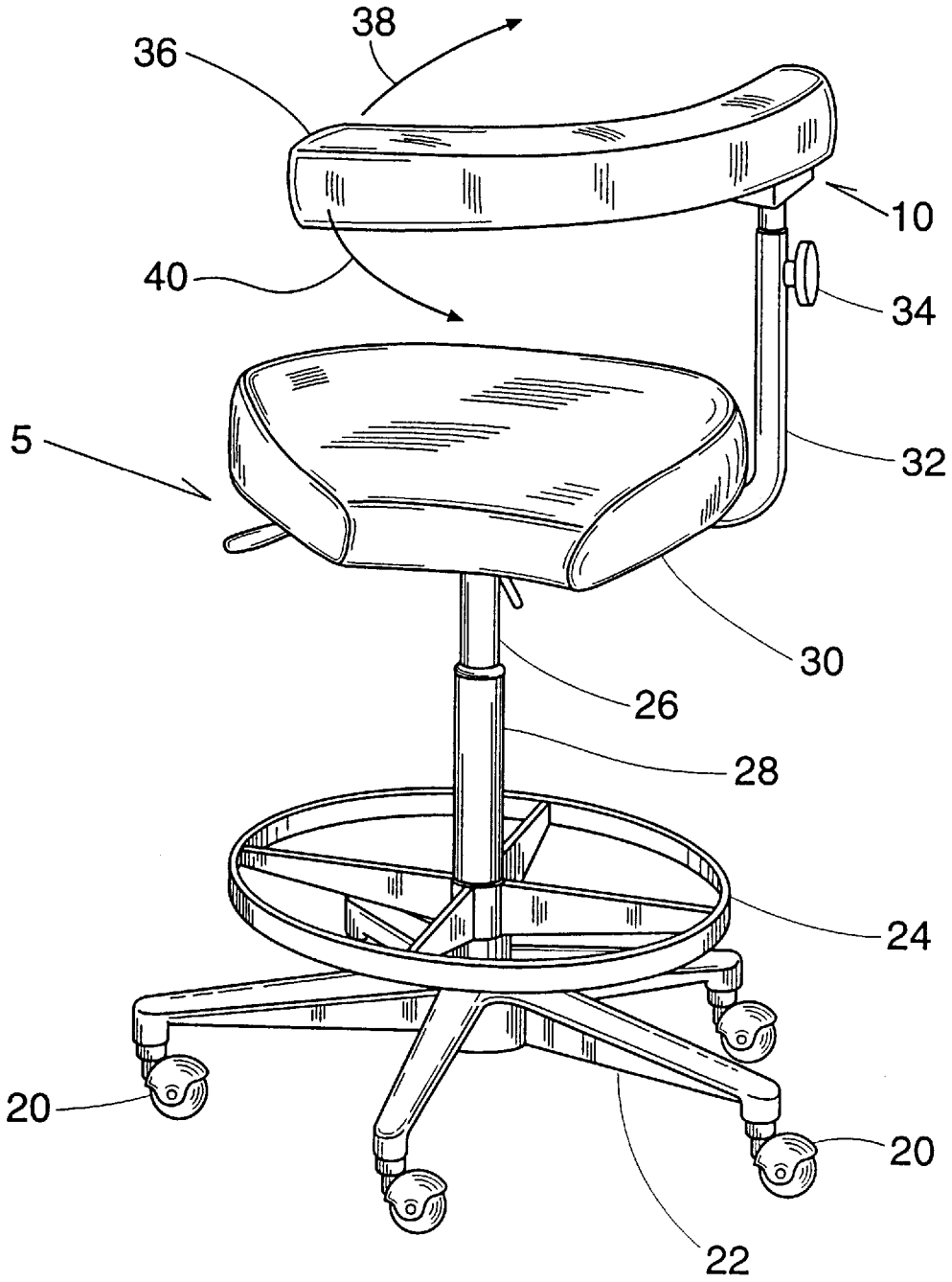
FIG. 1 is a perspective view of a medical or dental stool having a body support member utilizing my invention.

My invention, which is generally depicted by reference numeral 10 in FIGS. 1 through 7, comprises a body support ratcheting mechanism. Referring to FIG. 1, an application of my invention is shown. The stool 5 shown in FIG. 1 is known as an Assistant's Chair and its application is most commonly found in the medical and dental field.

Referring to FIG. 1 in detail, it can be seen that the Assistant's Chair 5 includes a plurality of casters 20, a pedestal base 22, a foot ring 24, a seat support tube 26 having a pneumatic height adjustment mechanism 28, a seat 30, a body support tube 32 including a hand wheel 34, my invention 10, and a body support member 36. Medical Assistant Chairs of this type are well known in the art.

As will be described in more detail herein, my body support ratcheting mechanism 10 allows the body support member 36 to be pivoted as shown by arrows 38 and 40. The pivoting action is performed on a plane that is generally parallel to the top of seat 30 and allows for the positive positioning of body support 36 relative to seat 30. Body support member 36 can be locked into an infinite number of positions relative to seat 30.

Figure 2:
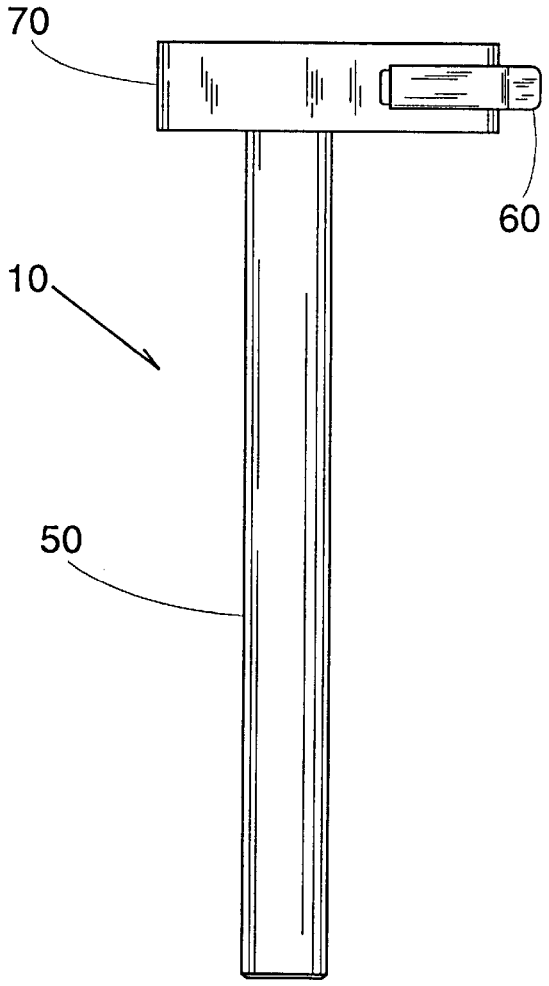
FIG. 2 is a front elevational view of the body support ratcheting mechanism.
Figure 3:
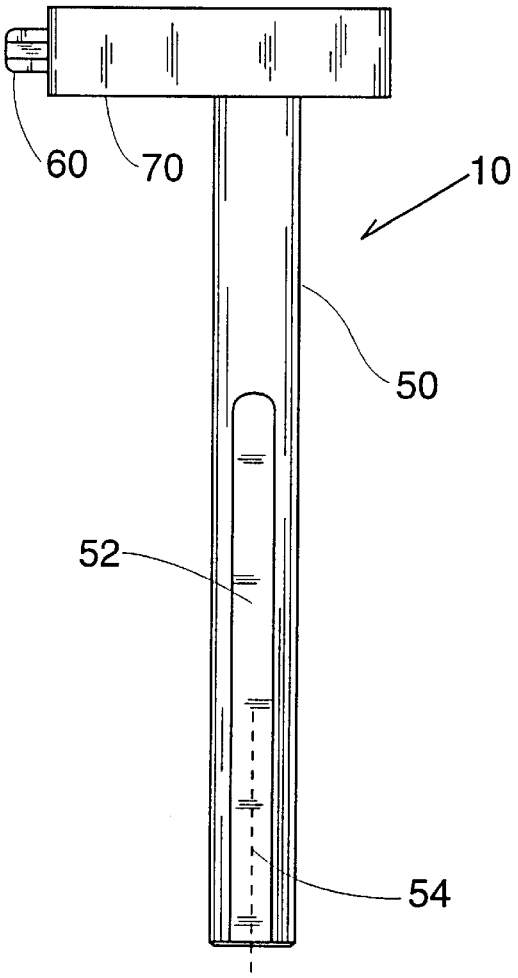
FIG. 3 is a rear elevational view of the body support ratcheting mechanism.
Figure 4:
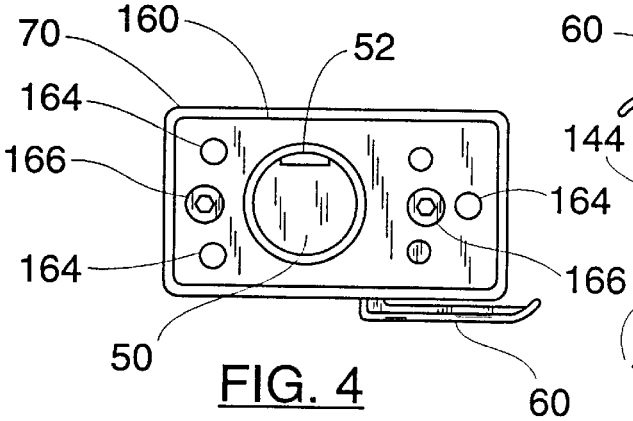
FIG. 4 is a bottom plan view of the body support ratcheting mechanism.
Figure 5:
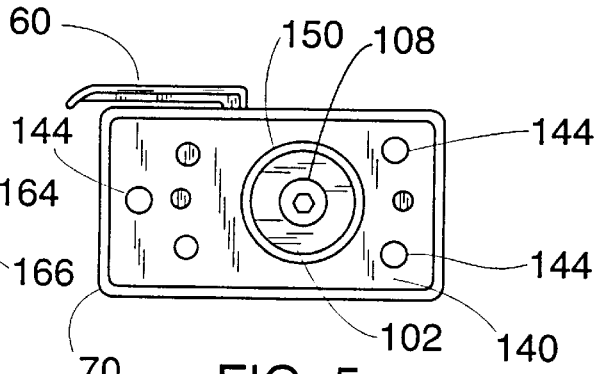
FIG. 5 is a top plan view of the body support ratcheting mechanism.

The body support ratcheting mechanism 10 and its components are shown in detail in FIGS. 2 through 8. Referring to FIGS. 2 through 4, the visible exterior components of the invention 10 are shown. They include a shaft 50, a release lever 60, and a ratchet housing 70. In my preferred embodiment, the shaft 50 is fabricated from a machinable grade of low carbon steel such as hot rolled steel, cold finish steel, cold drawn steel or ground and polished shafting round steel. The shaft 50 includes a keyway 52 that is cut along its longitudinal axis as shown. Referring back to FIG. 1, the shaft 50 fits into the open end of the body support tube 32. The keyway 52 receives the threaded end of the hand knob 34 shown in FIG. 1. The height of the body support member 36 relative to the seat 30 is selected and fixed in place through the use of the hand knob 34.

Figure 6:
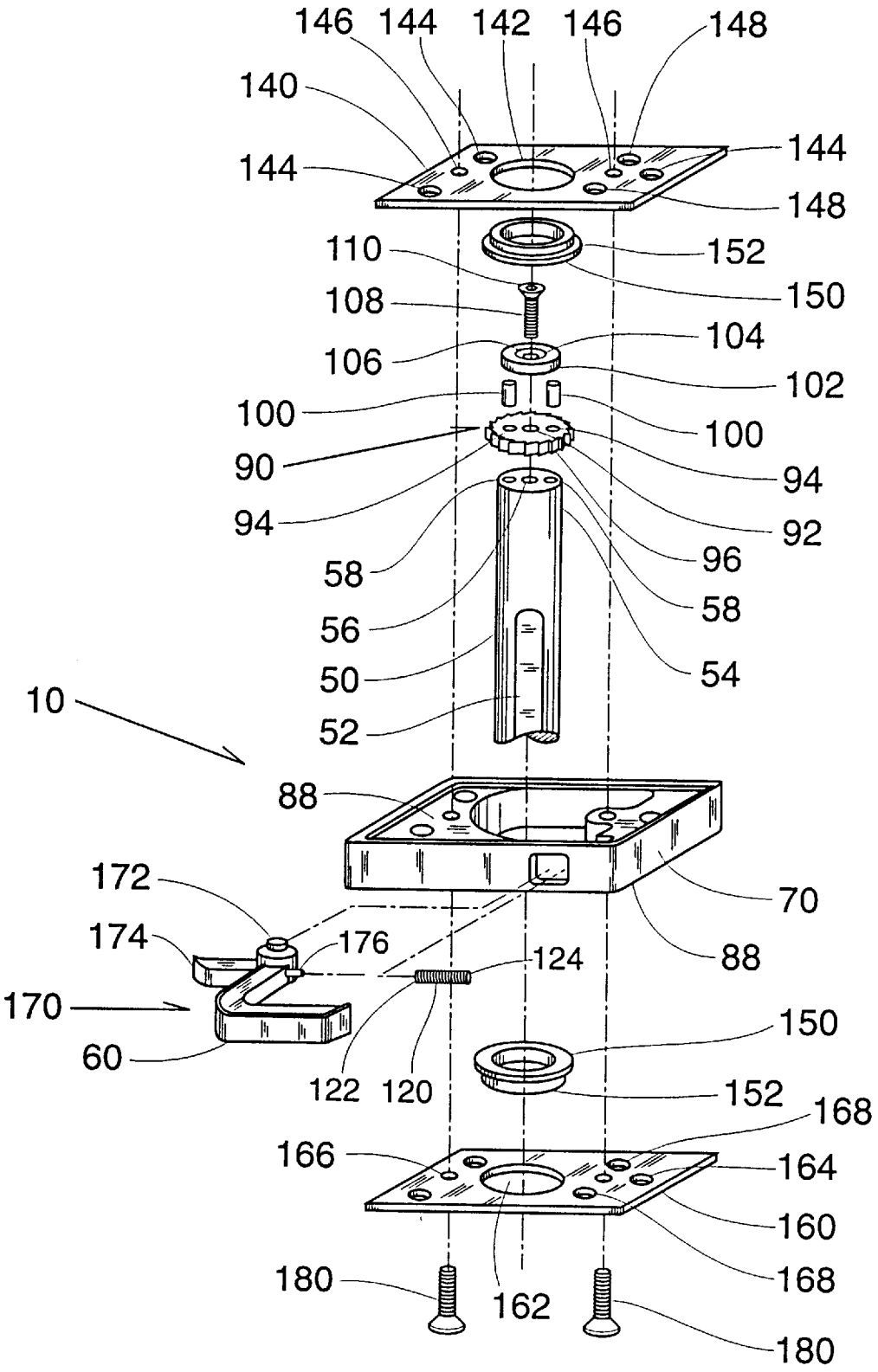
FIG. 6 is an exploded perspective view of the body support ratcheting mechanism

Referring now to FIG. 6, it can seen that the shaft 50 further includes three openings or apertures on its end 54 that resides within the ratchet housing 70. These apertures include a centered and threaded aperture 56 and two pin apertures 58. A ratchet gear 90 is positioned and connected to the top end 54 of shaft 50. Ratchet 90 also has three apertures that are identically spaced when compared to shaft end 54 including centered aperture 92 and pin apertures 94. The ratchet 90 further includes a plurality of ratchet gear teeth 96 along the periphery of its outer diameter. In my preferred embodiment, the ratchet 90 is fabricated from cold finish round steel having a low carbon case hardening. The ratchet gear teeth 96 have a diametrical pitch of 24 and a circular pitch of 0.1309.

The ratchet 90 is attached to shaft 50 by means of a pair of pins 100, a shaft end cap 102 and a threaded screw 108. Again referring to FIG. 6, it can be seen that the ratchet 90 rests on end 54 of shaft 50. The ratchet 90 is rotationally positioned so that shaft apertures 58 are in alignment with ratchet apertures 94. Next, the pins 100 are placed through the aligned apertures and the shaft end cap 102 is placed on top of the ratchet 90. Shaft end cap 102 also includes a centered aperture 104 and the shaft end cap's diameter is substantially equivalent to the diameter of shaft 50. Again in my preferred embodiment, the shaft end cap aperture includes a bevel 106 and can be fabricated from the same materials as shaft 50. Finally, the ratchet 90 is fixedly attached to the shaft 50 by means of threaded screw 108. The threaded screw 108 includes a tapered head 110, which is sized to be received within beveled aperture 104. This assembly fixedly attaches the ratchet 90 to the shaft 50 and further prevents any rotational motion of the ratchet 90 with respect to shaft 50. When ratchet 90 rotates, shaft 50 also rotates.

Figure 7:
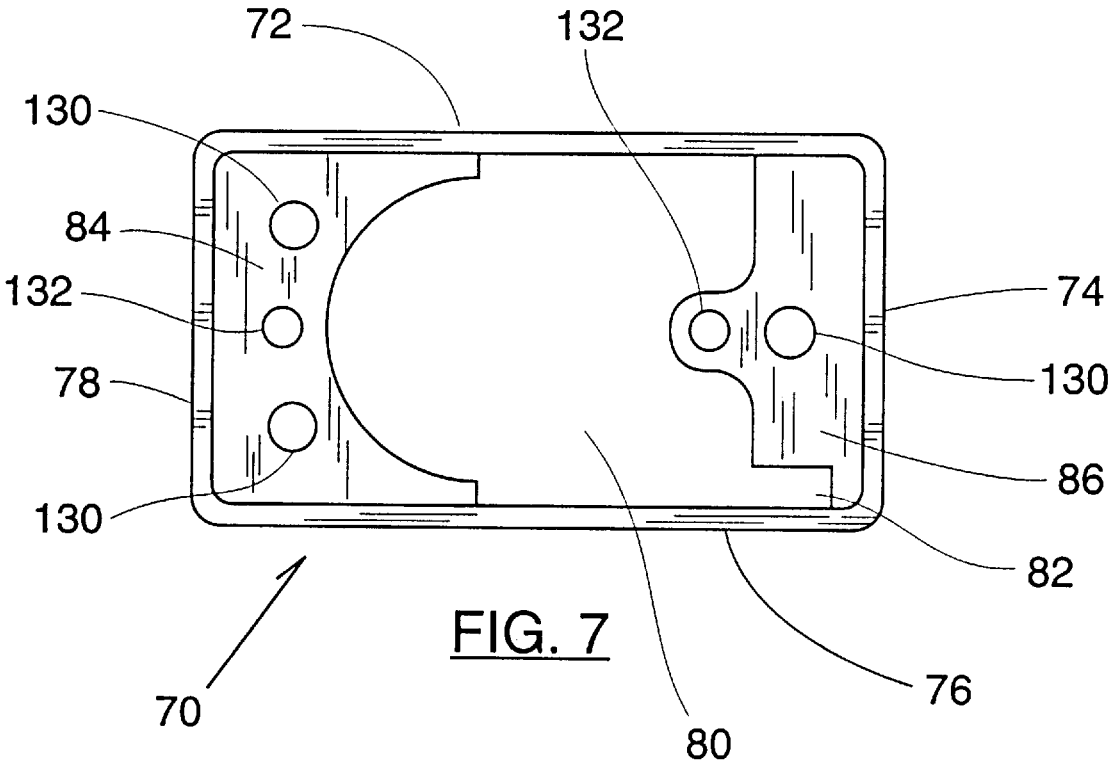
FIG. 7 is a top plan view of the body support ratcheting mechanism ratchet housing.

My ratcheting body support mechanism 10 further includes a ratchet body 70 whose function is to enclose the mechanical ratchet mechanism that will be discussed herein. Ratchet body 70 is shown in detail in FIGS. 6 and 7 and comprises a generally rectangular housing having four walls and two ribs that define an interior cavity. Referring now to FIG. 7, the walls can be seen as reference numerals 72, 74, 76, and 78 while the cavity is shown generally at 80. Formed within cavity 80 is subcavity 82 which houses a ratchet spring 120 whose function will be discussed in more detail below. Also supported by the walls 72–78 are a pair of interior ribs 84 and 86. The ribs 84 and 86 are positioned at opposite sides of interior cavity 80 and a plurality of openings or apertures pass through each rib. A pair of mounting apertures 130 pass through rib 84 and a single mounting aperture passes through rib 86. The mounting apertures 130 are utilized when connecting my body support ratcheting mechanism 10 to the body support member 36 of the chair or stool. Ribs 84 and 86 also have a pair of ratchet housing apertures 132 whose function will be discussed below.

In the preferred embodiment of my invention, the ratchet body 70 is fabricated from a plastic material that has the properties of high strength, excellent toughness, and impact resistance. The ratchet body 70 can be either molded or machined from a piece of plastic material.

Now referring back to FIG. 6, it can be seen that my invention 10 further utilizes a top bearing plate 140 and a bottom bearing plate 160. Each plate 140 and 160 fits within recessed portions 88 of ratchet body 70. Top bearing plate 140 includes a shaft bushing aperture 142, body support ratcheting mechanism mounting apertures 144 and ratchet body apertures 146. The mounting apertures 144 align with the mounting apertures 130 of ratchet body 70. The ratchet body apertures 146 align with apertures 132 of the ratchet body 70. Bottom bearing plate 160 has similarly aligned apertures 164 and 166. The bottom bearing plate 160 also includes a shaft aperture 162.

A bushing 150 having an inner diameter substantially equivalent to the shaft 50 outer diameter and an outer diameter substantially equivalent to shaft aperture diameters 142 and 152 of top bearing plate 140 and bottom bearing plate 160 is positioned within each respective plate. Each bushing 150 further includes a shoulder 152 having a diameter greater than that of bushing diameter 142 or 162 so that the bushing 150 will not pass completely through the shaft aperture 142 or 162. It is important to note, as shown in FIG. 6, the orientation of the bushings 150 in plates 140 and 160. Each bushing 150 is positioned so that its shoulder 152 is oriented toward the ratchet body 70 or the interior of the assembly.

Positioned within cavity 80 and pivotally connected to top bearing plate 140 and bottom bearing plate 160 is pawl member 170. Pawl member 170 can be seen in its entirety in FIGS. 6 and 8. The pawl member 170 includes a pair of top and bottom pivot pins 172 that are integral to the pawl 170. However, it should be understood that an aperture could be formed within the pawl member 170 and a separate pivot pin could be passed through said aperture. The ends of pivot pin 172 fit within apertures 148 on top bearing plate 140 and 168 on bottom bearing plate 160. As will be readily apparent in FIGS. 4, 5 and 6, each plate has two pawl pivot pin receiving apertures. This allows for the pawl to be mounted on either side of the ratchet body 70.

Figure 8:
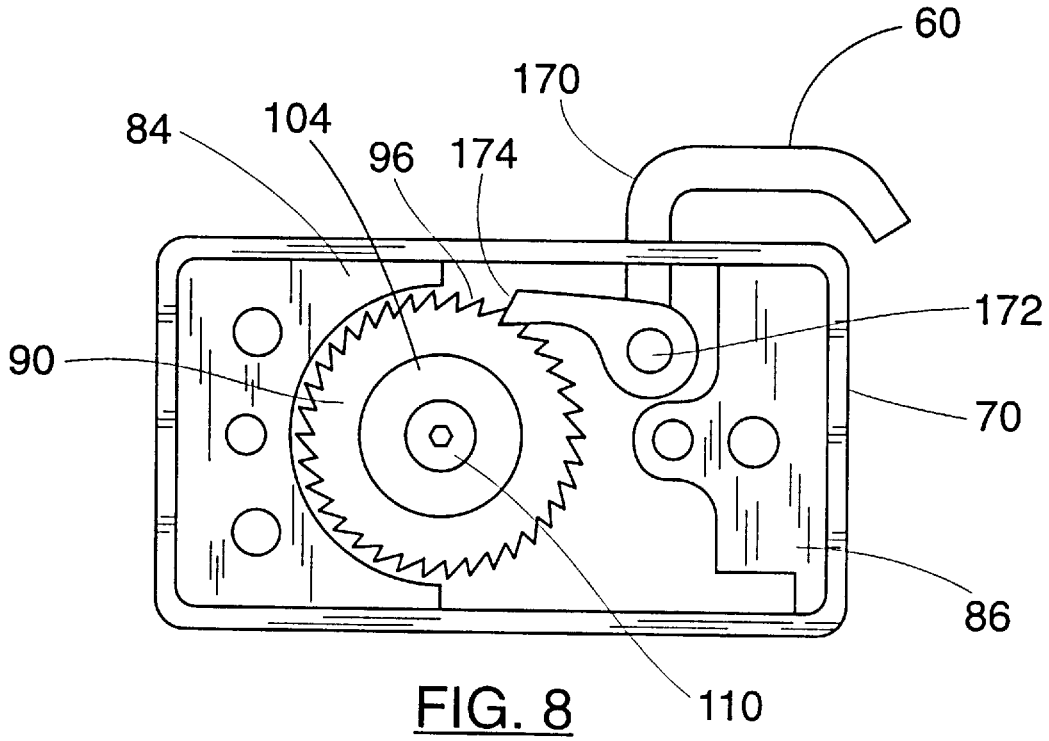
FIG. 8 is a top plan view of the body support ratcheting mechanism ratchet housing including the ratchet gear and pawl.

The pawl member 170 further includes an engaging member 174, a spring pin 176, and a release handle 60. When the pawl 170 is assembled within ratchet body 70 and pivotally connected to plates 140 and 160, engagement member 174 engages with one or more of the ratchet teeth 96 on ratchet 90. The geometry of the ratchet teeth 96 and the engagement of the pawl engagement member 174, as best shown in FIG. 8, allow the shaft 50 to rotate in one direction but prevents rotation in the opposite direction. This significance will be explained below.

The spring pin 176 provides a positive nesting area for end 122 of spring 120. Spring 120 extends between spring pin 176 and subcavity 82 within ratchet mechanism 70. Spring end 124 rests against the end of cavity 82. The spring 120 biases pawl 170 generally and engagement member 174 specifically into contact with ratchet gear 90. Referring now to FIG. 8, the relationship of the ratchet gear 90 and pawl engagement member 174 can be seen. Engagement member 174 fits into ratchet gear tooth 96 as shown. This allows the ratchet gear 90, and thus shaft 50, to rotate in the counter-clockwise direction and not rotate in the clockwise direction. By mounting pawl member 170 on the opposite side of the ratchet housing 70 and inverting the ratchet gear 90, the ratchet and shaft combination would be allowed to rotate in the clockwise direction and not in the counter-clockwise direction.

The entire assembly 10 is held together utilizing screws 180 which pass through bottom bearing plate apertures 166, ratchet body apertures 132 and top bearing plate apertures 146. In a preferred embodiment of my invention, apertures 146 are threaded to threadedly receive the screws 180. It should also be noted that it its possible to eliminate screws 180 and utilize the fasteners that pass through bottom bearing plate apertures 164, ratchet body apertures 130, top bearing plate apertures 144 and into the body support member for purposes of attaching my invention 10 the body support member.

Once in its assembled form, the body support ratchet mechanism 1 is installed on a chair or stool as shown in FIG. 1. The shaft 50 fits into top opening of body support tube or bracket 32 and is held at the proper height by tightening hand knob 34. The body support member 36 is attached to the upper surface of the body support ratcheting mechanism 10 by means of fasteners that pass through bottom bearing plate apertures 164, ratchet body apertures 130, top bearing plate apertures 144 and into the body support member.

When the pawl release handle 60 is biased inward toward the ratchet housing 70, the occupant of the stool can swing the body support member 36 away from its "in use" position above the stool seat 30. Arrow 40 in FIG. 1 depicts the swing away direction. This allows for easy ingress to and egress from the stool 5. Upon occupying the stool, the occupant draws the body support member 36 toward his or her abdomen in the direction shown by arrow 38 until a comfortable position has been established. If the occupant puts his or her weight against the body support 36, the interlocking contact of the pawl engagement 174 with the ratchet gear 90 will prevent movement of the body support 36 in the direction of arrow 40. Conversely, if the occupant desires to draw the body support 36 closer to his or her abdomen, this can be accomplished by pivoting body support 36 in the direction shown by arrow 38. Again, the interlocking contact of the pawl engagement 174 with the ratchet gear 90 will prevent any outward movement of the body support 36. When the occupant is ready to egress from the stool 5, he or she simply depresses the pawl handle 60. This disengages the pawl engagement member 174 from the ratchet gear 90 and allows the body support member 36 to be swung away from the stool 5.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A body support member for supporting a body resting upon a stool, the body support member being adapted to be mounted pivotably relative to said stool and including: a ratcheting mechanism for locking said support member in a selected pivotable position, said ratcheting mechanism comprising:

a ratchet housing attached to said body support member and having at least one wall arranged to define an open cavity;

a top and a bottom bearing plate, said plates being disposed above and below said ratchet housing respectively;

a shaft having a first end and a second end, said first end is adapted to be attached to said stool;

a ratchet gear having a plurality of ratchet teeth, said ratchet gear being mounted on the second end of said shaft; and a pawl having a pawl engagement member, a pivot point, and a release handle, said pawl being pivotally mounted between said top bearing plate and said bottom bearing plate and said pawl engagement member being engageable with at least one tooth of said ratchet gear teeth.

2. The body support member ratchet mechanism of claim 1 wherein said ratchet housing includes an opening and said pawl release handle passes through said opening.

3. The body support member ratchet mechanism of claim 1 further including at least one bushing, said bushing being positioned between said shaft and one of said plates.

4. The body support member ratcheting mechanism of claim 1 wherein said ratchet gear has at least a first and a second aperture formed therein and said shaft has at least a first and a second aperture formed therein;

said respective first and second apertures being in alignment;

a pin passing through said aligned first apertures;

a fastener passing through said second ratchet gear aperture and threadedly engaging with said shaft second aperture.

5. The body support member ratcheting mechanism of claim 1 further including a spring having a first end and a second end;

said first spring end biased against said ratchet body cavity;

said second spring end biased against said pawl.

6. A body support member for supporting a body resting upon a stool, said body support member being mounted pivotably relative to a stool and including:

a ratchet housing attached to said body support member and having an interior cavity;

an upper bearing plate and a lower bearing plate, the upper bearing plate and the lower bearing plate each having at least one shaft bearing, the upper plate being positioned on an upper surface of said ratchet housing and the lower plate being positioned on a lower surface of said ratchet housing;

a pawl, said pawl being pivotally mounted between said upper plate and said lower plate within the ratchet housing cavity;

a shaft having an end, said shaft passing through said lower plate shaft bearing and having a ratchet gear attached to said end;

said ratchet gear being located within said ratchet body and having a plurality of ratchet gear teeth, at least one gear tooth being engageable with said pawl; and a shaft end cap being attached to said ratchet gear, said shaft end cap passing through said upper plate shaft bearing.

7. The body support member ratchet mechanism of claim 6 wherein said ratchet housing includes at least one opening and said pawl passes through said opening.

8. The body support member ratcheting mechanism of claim 6 further including at least one bushing, said bushing being positioned between said shaft and one of said plates.

9. The body support member ratcheting mechanism of claim 6 wherein said ratchet gear has at least a first and a second aperture formed therein and said shaft has at least a first and a second aperture formed therein;

said respective first and second apertures of said ratchet gear and said shaft being in alignment;

a pin passing through said aligned first apertures; and a fastener passing through said second ratchet gear aperture and threadedly engaging with said second shaft aperture.

10. The body support member ratcheting mechanism of claim 6 further including a spring having a first end and a second end;

said first spring end biased against said ratchet interior cavity;

said second spring end biased against said pawl.

11. A stool having a seat and a body support member connected to said stool above said seat, said body support member including a ratcheting mechanism comprising:

a shaft, said shaft having a first end and a second end, said first shaft end being connected to said stool;

a ratchet gear having a plurality of ratchet gear teeth, said ratchet gear being attached to said second end of said shaft;

a shaft end cap having a diameter substantially equivalent to said shaft, said end cap being attached to said ratchet gear;

a ratchet body having an interior cavity, said ratchet gear and said end cap being located within said interior cavity;

a pawl having a pawl engagement member, said pawl being pivotally mounted within said ratchet body;

said pawl engagement member biased by a spring into removable contact with at least one ratchet gear tooth;

said ratchet body having at least one bearing for supporting said shaft within said body member and a mounting surface; and said body support member being attached to said mounting surface.

* * * * *